US011431435B2

(12) United States Patent
Upadhya et al.

(10) Patent No.: US 11,431,435 B2
(45) Date of Patent: Aug. 30, 2022

(54) PROTECTING TRANSMISSIONS AGAINST JAMMING

(71) Applicant: NOKIA TECHNOLOGIES OY, Espoo (FI)

(72) Inventors: Karthik Upadhya, Espoo (FI); Tero Johannes Ihalainen, Nokia (FI); Dani Johannes Korpi, Helsinki (FI); Martti Johannes Moisio, Perttula (FI); Mikko Aleksi Uusitalo, Helsinki (FI); Paolo Baracca, Stuttgart (DE); Saeed Reza Khosravirad, Mountainside, NJ (US)

(73) Assignee: NOKIA TECHNOLOGIES OY, Espoo (FI)

( * ) Notice: Subject to any disclaimer, the term of this patent is extended or adjusted under 35 U.S.C. 154(b) by 0 days.

(21) Appl. No.: 17/574,097

(22) Filed: Jan. 12, 2022

(65) Prior Publication Data

US 2022/0247511 A1 Aug. 4, 2022

(30) Foreign Application Priority Data

Jan. 20, 2021 (FI) ..... 20215062

(51) Int. Cl.
*H04K 3/00* (2006.01)

(52) U.S. Cl.
CPC ..... *H04K 3/65* (2013.01); *H04K 3/224* (2013.01); *H04K 3/42* (2013.01)

(58) Field of Classification Search
CPC ..... H04K 3/65; H04K 3/224; H04K 3/42
See application file for complete search history.

(56) References Cited

U.S. PATENT DOCUMENTS

| | | | |
|---|---|---|---|
| 10,863,348 | B1 | 12/2020 | Liberti et al. |
| 2011/0033051 | A1 | 2/2011 | Steer et al. |
| 2014/0219449 | A1 | 8/2014 | Shattil et al. |
| 2019/0281487 | A1 | 9/2019 | Liu et al. |

(Continued)

FOREIGN PATENT DOCUMENTS

| | | | |
|---|---|---|---|
| KR | 102005098 | B1 | 7/2019 |
| WO | 2008/086599 | A1 | 7/2008 |

OTHER PUBLICATIONS

Office Action dated Jun. 4, 2021 corresponding to Finnish Patent Application No. 20215062.

(Continued)

*Primary Examiner* — Keith Ferguson
(74) *Attorney, Agent, or Firm* — Squire Patton Boggs (US) LLP

(57) ABSTRACT

This document discloses a solution for performing anti-jamming procedures. According to an aspect, a method for a terminal device comprises: receiving a first reference signal allocation from an access node, wherein the first reference signal is unique to the terminal device in a cell managed by the access node; receiving a second reference signal allocation from the access node, wherein the second reference signal is shared with at least one other terminal device in the cell; causing transmission of payload data together with the first reference signal according to a regular transmission pattern; and breaking the regular transmission pattern by transmitting dummy data together with the second reference signal in a time-frequency resource shared with the at least one other terminal device.

19 Claims, 7 Drawing Sheets

(56) References Cited

U.S. PATENT DOCUMENTS

2019/0349159 A1 11/2019 Nammi
2021/0083794 A1* 3/2021 Agarwal ..... H04L 5/0048

OTHER PUBLICATIONS

Finnish Search Report dated Jun. 4, 2021 corresponding to Finnish Patent Application No. 20215062.
Communication of Acceptance—section 29 a of Patents Decree dated Nov. 29, 2021 corresponding to Finnish Patent Application No. 20215062.
3GPP TR 33.809 V0.12.1 (Dec. 2020), Technical Report, 3rd Generation Partnership Project; Technical Specification Group Services and System Aspects Study on 5G Security Enhancement against False Base Stations (FBS) (Release 17), Dec. 16, 2020.
Extended European Search Report dated Jun. 20, 2022 corresponding to European Patent Application No. 21218456.8.
Japanese Office Action corresponding to JP Appln. No. 2022-005618, dated Jun. 14, 2022.
Ericsson, "E-UTRA Random Access", TSG-RAN WG1 #43, Seoul, Korea, Nov. 7-11, 2005, R1-051445, 4 pages.

* cited by examiner

PROTECTING TRANSMISSIONS AGAINST JAMMING

FIELD

Various embodiments described herein relate to the field of wireless communications and, particularly, to protecting transmissions against intentional interference also known as jamming.

BACKGROUND

Cellular communication systems employ mechanisms that result in a terminal device transmitting in a regular manner. Such mechanisms may be based on quality-of-service (QoS) requirements or efficient scheduling. For example, certain services may require low-latency transmissions with high reliability and one solution may be to allocate uplink resources by using persistent or semi-persistent scheduling where a periodic transmission resource is allocated to the terminal device. Such scheduling may also reduce signaling overhead.

A reactive jammer system may be configured to monitor traffic in a radio channel and to detect patterns in the traffic. One such a pattern is periodic transmission by a given transmitter. Upon detecting such a periodic transmission and determining to interfere with the transmission, the jamming system may start transmitting a jamming signal in the same periodic time-frequency resources as the transmitter.

BRIEF DESCRIPTION

Some aspects of the invention are defined by the independent claims.

Some embodiments of the invention are defined in the dependent claims.

The embodiments and features, if any, described in this specification that do not fall under the scope of the independent claims are to be interpreted as examples useful for understanding various embodiments of the invention. Some aspects of the disclosure are defined by the independent claims.

According to an aspect, there is provided an apparatus for a terminal device, comprising: at least one processor; and at least one memory including computer program code, wherein the at least one memory and computer program code are configured, with the at least one processor, to cause the apparatus to perform the following: receiving a first reference signal allocation from an access node, wherein the first reference signal is unique to the terminal device in a cell managed by the access node; receiving a second reference signal allocation from the access node, wherein the second reference signal is shared with at least one other terminal device in the cell; causing transmission of payload data together with the first reference signal according to a regular transmission pattern; and breaking the regular transmission pattern by transmitting dummy data together with the second reference signal in a time-frequency resource shared with the at least one other terminal device.

In an embodiment, the at least one memory and computer program code are configured, with the at least one processor, to cause the apparatus to generate the dummy data by using the same pseudo-random data generator configuration as the at least one other terminal device and to transmit the same dummy data as the at least one other terminal device in the time-frequency resource.

In an embodiment, the at least one memory and computer program code are configured, with the at least one processor, to cause the apparatus to receive a seed for the pseudo-random data generator from the access node.

In an embodiment, the at least one memory and computer program code are configured, with the at least one processor, to cause the apparatus to determine the time-frequency resource by using a pseudo-random generator.

In an embodiment, the at least one memory and computer program code are configured, with the at least one processor, to cause the apparatus to use a time-frequency resource index indicating the determined time-frequency resource as a seed for the pseudo-random data generator configured to generate the dummy data for the determined time-frequency resource.

In an embodiment, the at least one memory and computer program code are configured, with the at least one processor, to cause the apparatus to transmit first payload data together with the first reference signal, to change to a third reference signal that is also unique to the terminal device in the cell, and to transmit second payload data together with the third reference signal.

In an embodiment, the at least one memory and computer program code are configured, with the at least one processor, to cause the apparatus to enable the transmission of the dummy data upon receiving, from the access node, a message configuring the dummy data transmission.

According to an aspect, there is provided an apparatus for a network node, comprising: at least one processor; and at least one memory including computer program code, wherein the at least one memory and computer program code are configured, with the at least one processor, to cause the apparatus to perform the following: transmitting, to a first terminal device, an allocation of a first reference signal that is unique to the first terminal device in a cell managed by the access node and, further, an allocation of a second reference signal; transmitting, to a second terminal device, an allocation of the second reference signal; receiving, from the first terminal device, payload data together with the first reference signal according to a regular transmission pattern and, further, receiving from the first terminal device and the second terminal device dummy data together with the second reference signal in a time-frequency resource shared between the first terminal device and the second terminal device.

In an embodiment, the at least one memory and computer program code are configured, with the at least one processor, to cause the apparatus to perform, on the basis of the received second reference signal, a spatial interference cancellation where a reception null is directed towards a reception direction or directions of the second reference signal.

In an embodiment, dummy data received from the first terminal device is identical with the dummy data received from the second terminal device, and wherein the at least one memory and computer program code are configured, with the at least one processor, to cause the apparatus to compute interference cancellation parameters on the basis of the received dummy data and the second reference signal, and to cancel, by using the interference cancellation parameters, a signal comprising the dummy data and the second reference signal from a signal carrying payload data received from a third terminal device in the time-frequency resource.

In an embodiment, the at least one memory and computer program code are configured, with the at least one processor, to cause the apparatus to transmit to the first terminal device and the second terminal device a seed for a pseudo-random data generator generating the dummy data, wherein the seed is the same for the first terminal device and the second terminal device.

In an embodiment, the at least one memory and computer program code are configured, with the at least one processor, to cause the apparatus to transmit to the first terminal device and the second terminal device a seed for a pseudo-random generator determining the time-frequency resource, wherein the seed is the same for the first terminal device and the second terminal device.

In an embodiment, the at least one memory and computer program code are configured, with the at least one processor, to cause the apparatus to transmit to the first terminal device and the second terminal device a seed for a pseudo-random generator determining the time-frequency resource, wherein the seed is different for the first terminal device than for the second terminal device, to receive from the first terminal device and second terminal device different dummy data when the first terminal device transmits the dummy data in a different time-frequency resource than the second terminal device, and to receive from the first terminal device and second terminal device same dummy data when the first terminal device and the second terminal device both transmit the dummy data in the same time-frequency resource.

In an embodiment, the at least one memory and computer program code are configured, with the at least one processor, to cause the apparatus to transmit to the first terminal device a configuration defining how to change the first reference signal to a third reference signal that is also unique to the first terminal device in the cell, and to receive further payload data together with the third reference signal from the first terminal device.

In an embodiment, the at least one memory and computer program code are configured, with the at least one processor, to cause the apparatus to detect presence of a radio jamming device and, in response to said detection, transmit to the first terminal device and the second terminal device a message enabling the transmission of the dummy data.

According to an aspect, there is provided a method comprising: receiving, by a terminal device, a first reference signal allocation from an access node, wherein the first reference signal is unique to the terminal device in a cell managed by the access node; receiving, by the terminal device, a second reference signal allocation from the access node, wherein the second reference signal is shared with at least one other terminal device in the cell; causing, by the terminal device, transmission of payload data together with the first reference signal according to a regular transmission pattern; and breaking, by the terminal device, the regular transmission pattern by transmitting dummy data together with the second reference signal in a time-frequency resource shared with the at least one other terminal device.

According to an aspect, there is provided a method comprising: transmitting, by an access node to a first terminal device, an allocation of a first reference signal that is unique to the first terminal device in a cell managed by the access node and, further, an allocation of a second reference signal; transmitting, by the access node to a second terminal device, an allocation of the second reference signal; receiving, by the access node from the first terminal device, payload data together with the first reference signal according to a regular transmission pattern and, further, receiving from the first terminal device and the second terminal device dummy data together with the second reference signal in a time-frequency resource shared between the first terminal device and the second terminal device.

According to an aspect, there is provided a computer program product embodied on a computer-readable medium and comprising a computer program code readable by a computer, wherein the computer program code configures the computer to carry out a computer process for a terminal device, comprising: receiving a first reference signal allocation from an access node, wherein the first reference signal is unique to the terminal device in a cell managed by the access node; receiving a second reference signal allocation from the access node, wherein the second reference signal is shared with at least one other terminal device in the cell; causing transmission of payload data together with the first reference signal according to a regular transmission pattern; and breaking the regular transmission pattern by transmitting dummy data together with the second reference signal in a time-frequency resource shared with the at least one other terminal device.

According to an aspect, there is provided a computer program product embodied on a computer-readable medium and comprising a computer program code readable by a computer, wherein the computer program code configures the computer to carry out a computer process for an access node, comprising: transmitting, to a first terminal device, an allocation of a first reference signal that is unique to the first terminal device in a cell managed by the access node and, further, an allocation of a second reference signal; transmitting, to a second terminal device, an allocation of the second reference signal; receiving, from the first terminal device, payload data together with the first reference signal according to a regular transmission pattern and, further, receiving from the first terminal device and the second terminal device dummy data together with the second reference signal in a time-frequency resource shared between the first terminal device and the second terminal device.

LIST OF DRAWINGS

Embodiments are described below, by way of example only, with reference to the accompanying drawings, in which FIG. 1 illustrates a wireless communication scenario to which some embodiments of the invention may be applied;

DESCRIPTION OF EMBODIMENTS

The following embodiments are examples. Although the specification may refer to "an", "one", or "some" embodiment(s) in several locations, this does not necessarily mean that each such reference is to the same embodiment(s), or that the feature only applies to a single embodiment. Single features of different embodiments may also be combined to provide other embodiments. Furthermore, words "comprising" and "including" should be understood as not limiting the described embodiments to consist of only those features that have been mentioned and such embodiments may contain also features/structures that have not been specifically mentioned.

In the following, different exemplifying embodiments will be described using, as an example of an access architecture to which the embodiments may be applied, a radio access architecture based on long term evolution advanced (LTE Advanced, LTE-A) or new radio (NR, 5G), without restricting the embodiments to such an architecture, however. A person skilled in the art will realize that the embodiments may also be applied to other kinds of communications networks having suitable means by adjusting parameters and procedures appropriately. Some examples of other options for suitable systems are the universal mobile telecommunications system (UMTS) radio access network (UTRAN or E-UTRAN), long term evolution (LTE, the same as E-UTRA), wireless local area network (WLAN or WiFi), worldwide interoperability for microwave access (WiMAX), Bluetooth®, personal communications services (PCS), ZigBee®, wideband code division multiple access (WCDMA), systems using ultra-wideband (UWB) technology, sensor networks, mobile ad-hoc networks (MANETs) and Internet Protocol multimedia subsystems (IMS) or any combination thereof.

Figure 1:
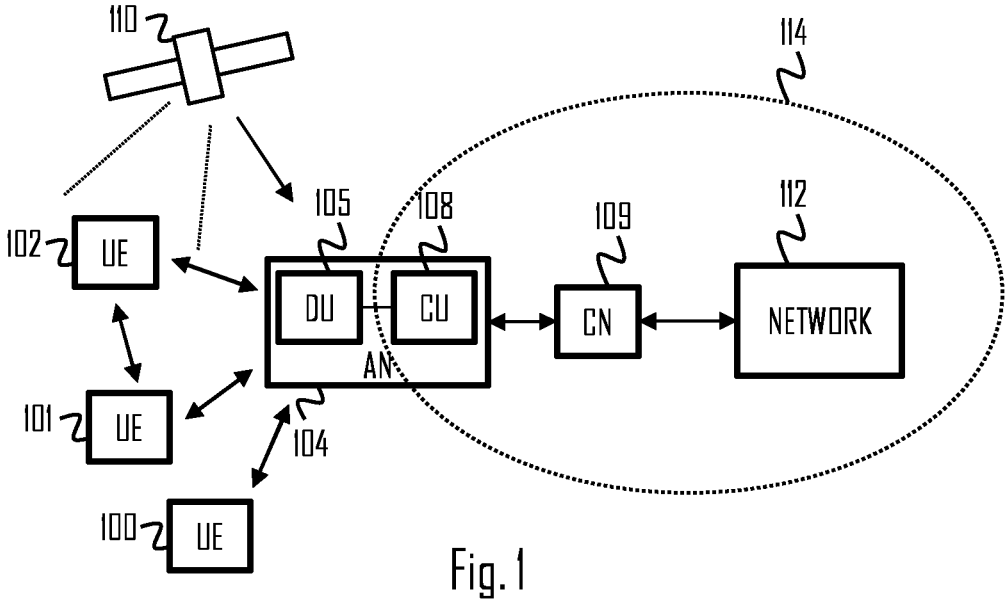

FIG. 1 depicts examples of simplified system architectures only showing some elements and functional entities, all being logical units, whose implementation may differ from what is shown. The connections shown in FIG. 1 are logical connections; the actual physical connections may be different. It is apparent to a person skilled in the art that the system typically comprises also other functions and structures than those shown in FIG. 1.

The embodiments are not, however, restricted to the system given as an example but a person skilled in the art may apply the solution to other communication systems provided with necessary properties.

The example of FIG. 1 shows a part of an exemplifying radio access network.

FIG. 1 shows terminal devices or user devices 100, 101, and 102 configured to be in a wireless connection on one or more communication channels in a cell with an access node AN (such as (e/g)NodeB) 104 providing the cell. (e/g) NodeB refers to an eNodeB or a gNodeB, as defined in 3GPP specifications. The physical link from a user device to a (e/g)NodeB is called uplink or reverse link and the physical link from the (e/g)NodeB to the user device is called downlink or forward link. It should be appreciated that (e/g)NodeBs or their functionalities may be implemented by using any node, host, server or access point etc. entity suitable for such a usage.

A communications system typically comprises more than one (e/g)NodeB in which case the (e/g)NodeBs may also be configured to communicate with one another over links, wired or wireless, designed for the purpose. These links may be used not only for signalling purposes but also for routing data from one (e/g)NodeB to another. The (e/g)NodeB is a computing device configured to control the radio resources of communication system it is coupled to. The NodeB may also be referred to as a base station, an access point, an access node, or any other type of interfacing device including a relay station capable of operating in a wireless environment. The (e/g)NodeB includes or is coupled to transceivers. From the transceivers of the (e/g)NodeB, a connection is provided to an antenna unit that establishes bi-directional radio links to user devices. The antenna unit may comprise a plurality of antennas or antenna elements. The (e/g)NodeB is further connected to a core network 109 (CN or next generation core NGC). Depending on the system, the counterpart on the CN side can be a serving gateway (S-GW, routing and forwarding user data packets), packet data network gateway (P-GW), for providing connectivity of user devices (UEs) to external packet data networks, or mobile management entity (MME), etc.

The user device (also called user equipment UE, user terminal, terminal device, etc.) illustrates one type of an apparatus to which resources on the air interface are allocated and assigned, and thus any feature described herein with a user device may be implemented with a corresponding apparatus, such as a relay node. An example of such a relay node is a layer 3 relay (self-backhauling relay) towards the base station. 5G specifications define two relay modes: out-of-band relay where same or different carriers may be defined for an access link and a backhaul link; and in-band-relay where the same carrier frequency or radio resources are used for both access and backhaul links. In-band relay may be seen as a baseline relay scenario. A relay node is called an integrated access and backhaul (IAB) node. It has also inbuilt support for multiple relay hops. IAB operation assumes a so-called split architecture having CU and a number of DUs. An IAB node contains two separate functionalities: DU (Distributed Unit) part of the IAB node facilitates the gNB (access node) functionalities in a relay cell, i.e. it serves as the access link; and a mobile termination (MT) part of the IAB node that facilitates the backhaul connection. A Donor node (DU part) communicates with the MT part of the IAB node, and it has a wired connection to the CU which again has a connection to the core network. In the multihop scenario, MT part (a child IAB node) communicates with a DU part of the parent IAB node.

The user device typically refers to a portable computing device that includes wireless mobile communication devices operating with or without a subscriber identification module (SIM), including, but not limited to, the following types of devices: a mobile station (mobile phone), smartphone, personal digital assistant (PDA), handset, device using a wireless modem (alarm or measurement device, etc.), laptop and/or touch screen computer, tablet, game console, notebook, and multimedia device. It should be appreciated that a user device may also be a nearly exclusive uplink only device, of which an example is a camera or video camera loading images or video clips to a network. A user device may also be a device having capability to operate in Internet of Things (IoT) network which is a scenario in which objects are provided with the ability to transfer data over a network without requiring human-to-human or human-to-computer interaction. The user device may also utilize cloud. In some applications, a user device may comprise a small portable device with radio parts (such as a watch, earphones or eyeglasses) and the computation is carried out in the cloud. The user device (or in some embodiments a layer 3 relay node) is configured to perform one or more of user equipment functionalities. The user device may also be called a subscriber unit, mobile station, remote terminal, access terminal, user terminal or user equipment (UE) just to mention but a few names or apparatuses.

Various techniques described herein may also be applied to a cyber-physical system (CPS) (a system of collaborating computational elements controlling physical entities). CPS may enable the implementation and exploitation of massive amounts of interconnected ICT devices (sensors, actuators, processors microcontrollers, etc.) embedded in physical objects at different locations. Mobile cyber physical systems, in which the physical system in question has inherent mobility, are a subcategory of cyber-physical systems. Examples of mobile physical systems include mobile robotics and electronics transported by humans or animals.

Additionally, although the apparatuses have been depicted as single entities, different units, processors and/or memory units (not all shown in FIG. 1) may be implemented.

5G enables using multiple input-multiple output (MIMO) antennas, many more base stations or nodes than the LTE (a so-called small cell concept), including macro sites operating in co-operation with smaller stations and employing a variety of radio technologies depending on service needs, use cases and/or spectrum available. 5G mobile communications supports a wide range of use cases and related applications including video streaming, augmented reality, different ways of data sharing and various forms of machine type applications (such as (massive) machine-type communications (mMTC), including vehicular safety, different sensors and real-time control. 5G is expected to have multiple radio interfaces, namely below 6 GHz, cmWave and mmWave, and also being capable of being integrated with existing legacy radio access technologies, such as the LTE. Integration with the LTE may be implemented, at least in the early phase, as a system, where macro coverage is provided by the LTE and 5G radio interface access comes from small cells by aggregation to the LTE. In other words, 5G is planned to support both inter-RAT operability (such as LTE-5G) and inter-RI operability (inter-radio interface operability, such as below 6 GHz-cmWave, below 6 GHz-cmWave-mmWave). One of the concepts considered to be used in 5G networks is network slicing in which multiple independent and dedicated virtual sub-networks (network instances) may be created within the same infrastructure to run services that have different requirements on latency, reliability, throughput and mobility.

The current architecture in LTE networks is fully distributed in the radio and typically fully centralized in the core network. The low-latency applications and services in 5G require to bring the content close to the radio which leads to local break out and multi-access edge computing (MEC). 5G enables analytics and knowledge generation to occur at the source of the data. This approach requires leveraging resources that may not be continuously connected to a network such as laptops, smartphones, tablets and sensors. MEC provides a distributed computing environment for application and service hosting. It also has the ability to store and process content in close proximity to cellular subscribers for faster response time. Edge computing covers a wide range of technologies such as wireless sensor networks, mobile data acquisition, mobile signature analysis, cooperative distributed peer-to-peer ad hoc networking and processing also classifiable as local cloud/fog computing and grid/mesh computing, dew computing, mobile edge computing, cloudlet, distributed data storage and retrieval, autonomic self-healing networks, remote cloud services, augmented and virtual reality, data caching, Internet of Things (massive connectivity and/or latency critical), critical communications (autonomous vehicles, traffic safety, real-time analytics, time-critical control, healthcare applications).

The communication system is also able to communicate with other networks 112, such as a public switched telephone network or the Internet, or utilize services provided by them. The communication network may also be able to support the usage of cloud services, for example at least part of core network operations may be carried out as a cloud service (this is depicted in FIG. 1 by "cloud" 114). The communication system may also comprise a central control entity, or a like, providing facilities for networks of different operators to cooperate for example in spectrum sharing.

Edge cloud may be brought into radio access network (RAN) by utilizing network function virtualization (NFV) and software defined networking (SDN). Using edge cloud may mean access node operations to be carried out, at least partly, in a server, host or node operationally coupled to a remote radio head or base station comprising radio parts. It is also possible that node operations will be distributed among a plurality of servers, nodes or hosts. Application of cloudRAN architecture enables RAN real time functions being carried out at the RAN side (in a distributed unit, DU 105) and non-real time functions being carried out in a centralized manner (in a centralized unit, CU 108).

It should also be understood that the distribution of functions between core network operations and base station operations may differ from that of the LTE or even be non-existent. Some other technology advancements probably to be used are Big Data and all-IP, which may change the way networks are being constructed and managed. 5G (or new radio, NR) networks are being designed to support multiple hierarchies, where MEC servers can be placed between the core and the base station or node B (gNB). It should be appreciated that MEC can be applied in 4G networks as well.

5G may also utilize satellite communication to enhance or complement the coverage of 5G service, for example by providing backhauling. Possible use cases are providing service continuity for machine-to-machine (M2M) or Internet of Things (IoT) devices or for passengers on board of vehicles, or ensuring service availability for critical communications, and future railway, maritime, and/or aeronautical communications. Satellite communication may utilize geostationary earth orbit (GEO) satellite systems, but also low earth orbit (LEO) satellite systems, in particular mega-constellations (systems in which hundreds of (nano)satellites are deployed). Each satellite in the mega-constellation may cover several satellite-enabled network entities that create on-ground cells. The on-ground cells may be created through an on-ground relay node or by a gNB located on-ground or in a satellite.

It is obvious for a person skilled in the art that the depicted system is only an example of a part of a radio access system and in practice, the system may comprise a plurality of (e/g)NodeBs, the user device may have an access to a plurality of radio cells and the system may comprise also other apparatuses, such as physical layer relay nodes or other network elements, etc. At least one of the (e/g)NodeBs may be a Home(e/g)nodeB. Additionally, in a geographical area of a radio communication system a plurality of different kinds of radio cells as well as a plurality of radio cells may be provided. Radio cells may be macro cells (or umbrella cells) which are large cells, usually having a diameter of up to tens of kilometers, or smaller cells such as micro-, femto- or picocells. The (e/g)NodeBs of FIG. 1 may provide any kind of these cells. A cellular radio system may be implemented as a multilayer network including several kinds of cells. Typically, in multilayer networks, one access node provides one kind of a cell or cells, and thus a plurality of (e/g)NodeBs are required to provide such a network structure.

FIG. 1 also illustrates an interference scenario that is potential in some implementations. A source of intentional interference may be disposed in a coverage area of the cellular communication system in an attempt to interfere with communications in the cellular communication system. Such a source is illustrated in FIG. 1 by an aerial jamming device 110 that may be an aerial vehicle such as a drone or a satellite. However, the jamming device may be equally disposed on the ground level. The jamming device 110 may direct sensing towards the terminal devices 100 to 102 and analyze transmission patterns of the terminal devices. Upon discovering a pattern, the jamming device may focus an interference beam towards the access node 104 so as to interfere signal detection in the access node, thus interfering with uplink transmissions in the cell controlled by the access node 104.

As described in Background, certain cellular communication services inherently provide a regular transmission pattern. Examples of such services include the semi-persistent scheduling and other methods allocating a periodic radio resource to a terminal device. For example, ultra-reliable low latency communication (URLLC) services introduced in the 5G specifications may employ such regular transmission patterns in order to guarantee the low-latency requirement. Such regular transmission patterns may be susceptible to the jamming because, upon sniffing the regularity, the jammer device may focus the interference energy to the appropriate transmission resources, thus providing power-efficient jamming.

Embodiments described below provide the terminal device with capability of breaking the regular transmission pattern of payload data. As described above, the payload data may be transmitted with the regular transmission pattern to meet the latency requirement or another quality of service (QoS) requirement. The regular transmission pattern may be defined in terms of time and/or frequency regularity. For example, the transmissions may be periodic, i.e. transmission may occur with a regular/fixed transmission periodicity. As another example, the transmissions may be performed in the same frequency resources, e.g. in the same physical resource blocks (PRB) that are frequency resource units. Additionally, the terminal device may transmit dummy data in time-frequency resources between the time-frequency resources of the regular transmission pattern. Some embodiments employ frequency-hopping where consecutive transmissions of the payload data and/or dummy data are transmitted in at least partially different frequency resources.

Figure 2:
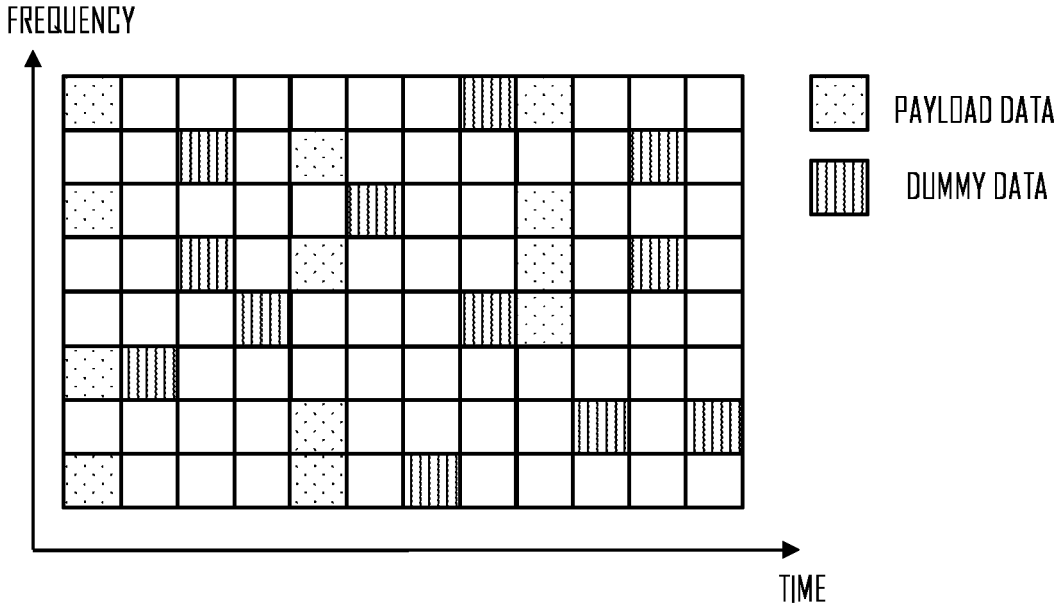
FIG. 2 illustrates an embodiment of hiding regularity of payload data transmissions.

FIG. 2 illustrates a transmission pattern of a terminal device in a time-frequency plane according to an embodiment. Dotted time-frequency resources represent transmission of payload data and lined time-frequency resources represent transmission of dummy data. As illustrated in FIG. 2, the payload data transmissions are periodic, and frequency-hopping is used for improved breakage of the regularity in the frequency domain in this embodiment although it is not mandatory. Between the periodic transmissions, the dummy data is transmitted in random or pseudo-random time-frequency resources. As seen from FIG. 2, it is difficult to distinguish any regularity in the transmission, thus effectively degrading the performance of the jammer device.

The dummy data occupies transmission resources and, without appropriate measures, may degrade the throughput and spectral efficiency in the cell because the dummy data would create interference, thus preventing transmission of payload data in those transmission resources by other terminal devices. When the number of terminal devices transmitting the dummy data is high, the degradation will scale up. Transmission of the dummy data and payload data in the same time-frequency resources is possible via multi-user multiple-input-multiple-output (MU-MIMO) transmissions and spatial multiplexing but that will require complex signal processing at the access node. In case the terminal devices cannot be separated in the spatial domain, interference cancellation is needed and the complexity rises in connection with a number of terminal devices transmitting dummy data in the same time-frequency resource as a terminal device transmitting payload data.

Figure 3:
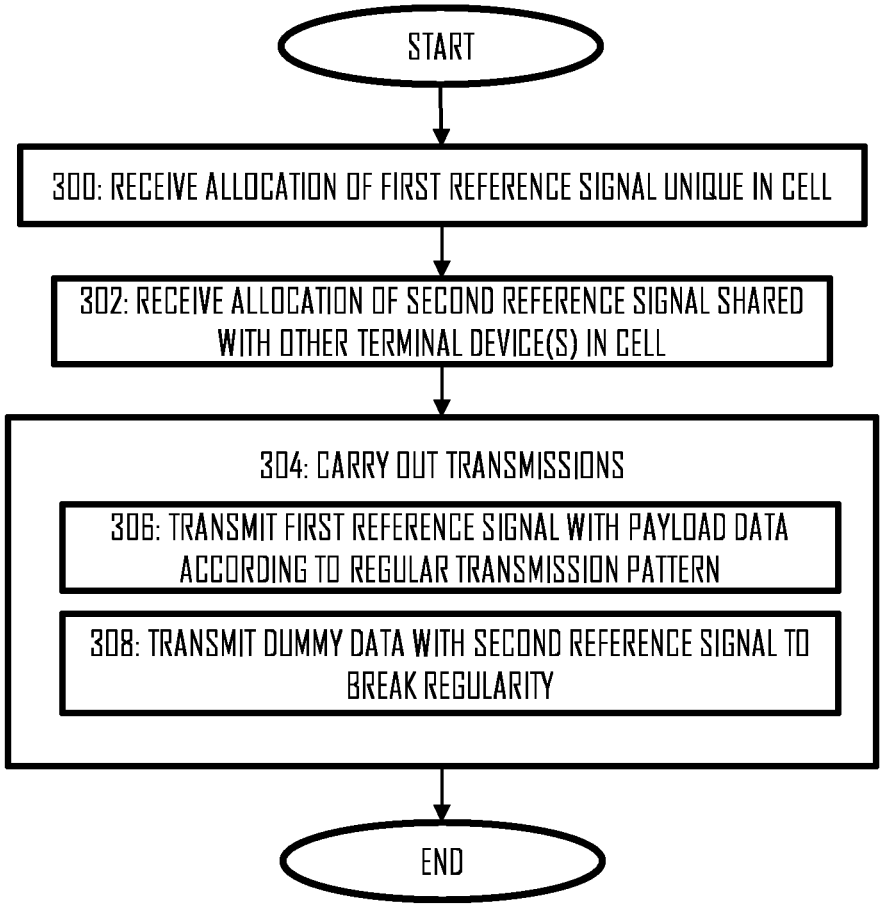
FIGS. 3 and 5 illustrate embodiments for carrying out dummy data transmissions.
Figure 5:
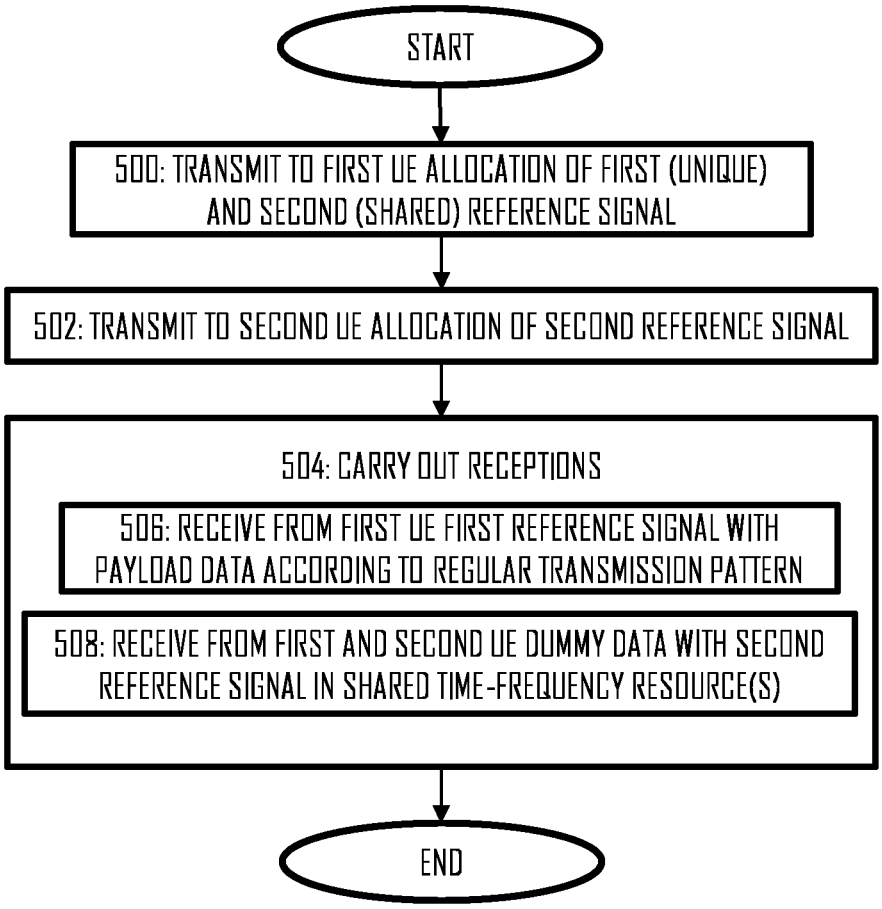

FIGS. 3 and 5 illustrate embodiments for arranging transmissions in the cell. FIG. 3 illustrates a process for a terminal device 100, 101, or 102 while FIG. 5 illustrates a process for the access node 104. Referring to FIG. 3, the process comprises as performed by an apparatus for the terminal device: receiving (block 300) a first reference signal allocation from an access node, wherein the first reference signal is unique to the terminal device in a cell managed by the access node; receiving (block 302) a second reference signal allocation from the access node, wherein the second reference signal is shared with at least one other terminal device in the cell; causing transmission (block 306) of payload data together with the first reference signal according to a regular transmission pattern; and breaking (block 308) the regular transmission pattern by transmitting dummy data together with the second reference signal in a time-frequency resource shared with the at least one other terminal device.

Accordingly, the terminal device carries out transmissions in block 304 by transmitting payload data with the unique reference signal, thus facilitating the detection of the payload data in the access node. Furthermore, the terminal device transmits the dummy data with the shared reference signal in the shared time-frequency resource, thus providing a coordinated multi-point transmission of the dummy data with the at least one other terminal device. The terminal devices may thus appear as a single virtual terminal device from the perspective of the access node, thus facilitating the interference cancellation, e.g. spatial interference cancellation.

The dummy data may be defined as artificially generated data bits (artificial data) that distinguish from the payload data in that the dummy data has no informational value. The payload data contains data bits that need to be communicated from a data source to a data sink, e.g. from the terminal device to an application server or to another terminal device. Another way of defining the dummy data is that the dummy data is benign information that does not contain any useful or meaningful data, but reserves transmission (time-frequency) resources where the payload data would be nominally present.

Figure 4:
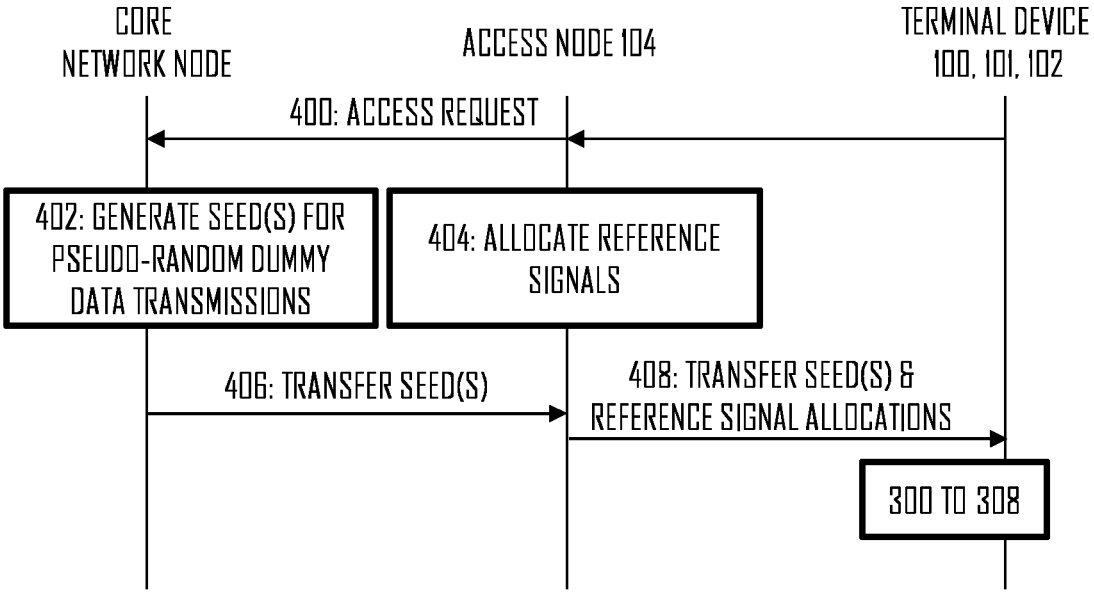
FIG. 4 illustrates a signalling diagram of an embodiment of setting up anti-jamming transmissions during a connection setup.

Before proceeding to FIG. 5, let us describe an embodiment for providing the shared reference signals and shared time-frequency resources for the dummy data transmissions, contributing to the advantage mentioned above. It should be appreciated that there may be other mechanisms for realizing the same technical effect. Referring to FIG. 4, upon requesting access to the cellular communication system in step 400, e.g. via a radio resource control (RRC) connection request and associated attach request specified in 3GPP specifications, the access node 104 may perform the allocation of the shared reference signals in block 404. In this embodiment, the time-frequency resource for the dummy data is determined by the terminal devices 100 to 102 by using a pseudo-random generator. The terminal devices may employ the same pseudo-random generator that provides time-frequency indices indicating the time-frequency resources for the dummy data. A seed for the generator may be provided by a core network node that generates the seed in block 402 in response to the access request. Further seed(s) described below may also be generated in block 402. In step 406, the core network node transfers the seed(s) to the access node and the access node delivers the seed(s) to the terminal devices 100 to 102. The access node transfers the reference signal allocations to the terminal devices also in step 408. The seed(s) and the reference signal allocations may be transferred in different messages. Upon receiving the necessary configurations, the terminal devices are capable of carrying out the process of FIG. 3. The terminal device may store the references signals and the seed(s) for the duration of the connection. The seed(s) may be transmitted after authentication and integrity protection have been performed and the seed(s) may be transferred in an encrypted form in order to prevent the jammer from eavesdropping the seed(s). The procedure of FIG. 4 may be performed for each terminal device 100 to 102 separately.

Let us then describe the embodiment of FIG. 3 from the perspective of the access node with reference to FIG. 5. Referring to FIG. 5, an apparatus for the access node may perform the following: transmitting (block 500), to a first terminal device, an allocation of a first reference signal that is unique to the first terminal device in a cell managed by the access node and, further, an allocation of a second reference signal; transmitting (block 502), to a second terminal device, an allocation of the second reference signal; receiving (block 506), from the first terminal device, payload data together with the first reference signal according to a regular transmission pattern and, further, receiving (block 508) from the first terminal device and the second terminal device dummy data together with the second reference signal in a time-frequency resource shared between the first terminal device and the second terminal device.

As described above, the embodiment of FIG. 5 provides the same effect: the terminal devices transmitting the dummy data with the shared reference signal become one virtual terminal device which reduces the complexity in the interference cancellation. The reference signal may be shared among two terminal devices served by the same cell. However, in other embodiments the sharing may be extended to a neighbour cell, e.g. two terminal devices served by different cells may share the second reference signal. In this case, an access node of either cell or both cells may be capable of detecting the terminal devices sharing the same reference signal.

Figure 6:
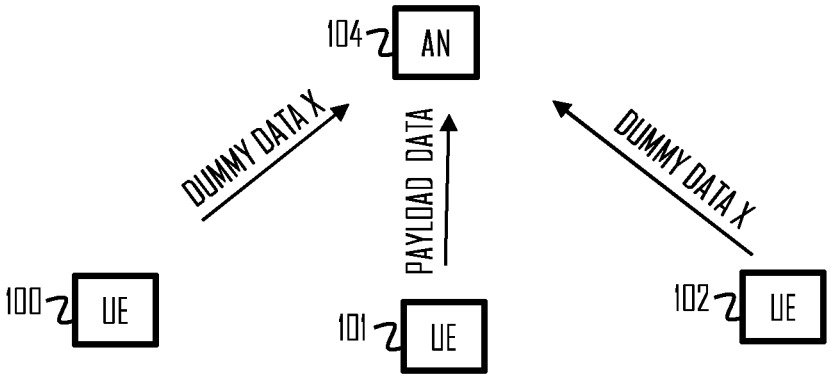
FIG. 6 illustrates a scenario where two terminal devices transmitting dummy data operate as a single virtual terminal device.

In an embodiment, the terminal devices generate the dummy data by using the same pseudo-random data generator configuration and, as a consequence, transmit the same dummy data in the same time-frequency resource. FIG. 6 illustrates this embodiment where the terminal device 101 transmits its payload data in a given time-frequency resource while the terminal devices 100 and 102 transmit the same dummy data X and the same reference signal in the time-frequency resource. Since the terminal devices all transmit in the same time-frequency resource, the access node 104 may need to perform interference cancellation in order to distinguish the payload data from the dummy data. Since the terminal devices 100 and 102 are seen by the access node 104 as a single terminal device, thanks to them transmitting the same dummy data and reference signal, the interference cancellation is simplified and more efficient.

In an embodiment, the terminal devices use the same pseudo-random generators and the same seeds for generating the time-frequency resources for the dummy data and the dummy data itself. As a consequence, the terminal devices transmit the same dummy data in the same time-frequency resources. In another embodiment, a first terminal device has a first pseudo-random generator used to generate the time-frequency resources (or indices thereof) where the first terminal device shall transmit the dummy data. The first terminal device may receive a seed for the first pseudo-random generator from the core network via the access node. The indices output by the first pseudo-random generator are then used as seeds for a second pseudo-random generator generating the dummy data for the respective time-frequency resources. For example, if the first pseudo-random generator outputs a time-frequency resource index X, X is used as a seed for the second pseudo-random generator for generating the dummy data for the time-frequency resource X. A second terminal device may use the same or different pseudo-random generator and seeds for generating the time-frequency indices for the dummy data as the first terminal device. However, the second terminal device may use the second pseudo-random generator with the time-frequency indices as the seeds for the second pseudo-random generator. An effect of this is that the terminal devices may transmit the dummy data in different time-frequency resources but, whenever they select the same time-frequency resource, they generate identical dummy data for the time-frequency resource because of the same seed and pseudo-random generator for the particular time-frequency resource.

In another embodiment, instead of transmitting dummy data, the terminal device may transmit a duplicate of payload data together with the shared reference signal for added diversity. The terminal device may transmit another duplicate of the payload data together with a unique reference signal. The probability of correctly receiving the duplicate of the payload data with the shared reference signal may be lower than the other duplicate, but the embodiment nevertheless improves the spectral efficiency because of reduced dummy data.

In an embodiment, one or more pseudo-random generators may be used to determine one or more of the following transmission parameters for transmitting the dummy data: a time resource index for transmitting the dummy data, a frequency resource index for transmitting the dummy data, and bits for the dummy data. A seed for each of these generators may be received from the core network node in steps 406 and 408, and terminal devices transmitting the dummy data may use the same generator and the same seed so that the benefits described above may be achieved.

In an embodiment, a pseudo-random generator is used to determine one or more transmission parameters for the payload data to break the regularity. An example of such a parameter is a frequency resource index, thus realizing pseudo-random frequency-hopping pattern for the payload data. A seed for this generator may be generated by the core network node or the access node and transferred to the terminal device in step 408.

In an embodiment, the terminal devices are configured to change the unique and/or shared reference signal according to a determined rule. For example, the access node may reallocate the reference signals to the terminal device during the connection according to a determined rule. For example, the unique reference signal and/or the shared reference signal may be allocated from a reference signal matrix comprising numerous reference signals that are mutually orthogonal or substantially orthogonal. The reference signal may be selected from the reference signal matrix in a rotational manner, for example. Accordingly, the terminal device may transmit first payload data together with the first reference signal, to change to another reference signal that is also unique to the terminal device in the cell and transmit second payload data together with the other reference signal.

By changing the reference signals, the jammer device is prevented from distinguishing the payload data and dummy data and learning a channel status of the payload data. Further, the jammer device is prevented from learning the reference signal used by the terminal device.

Figure 7:
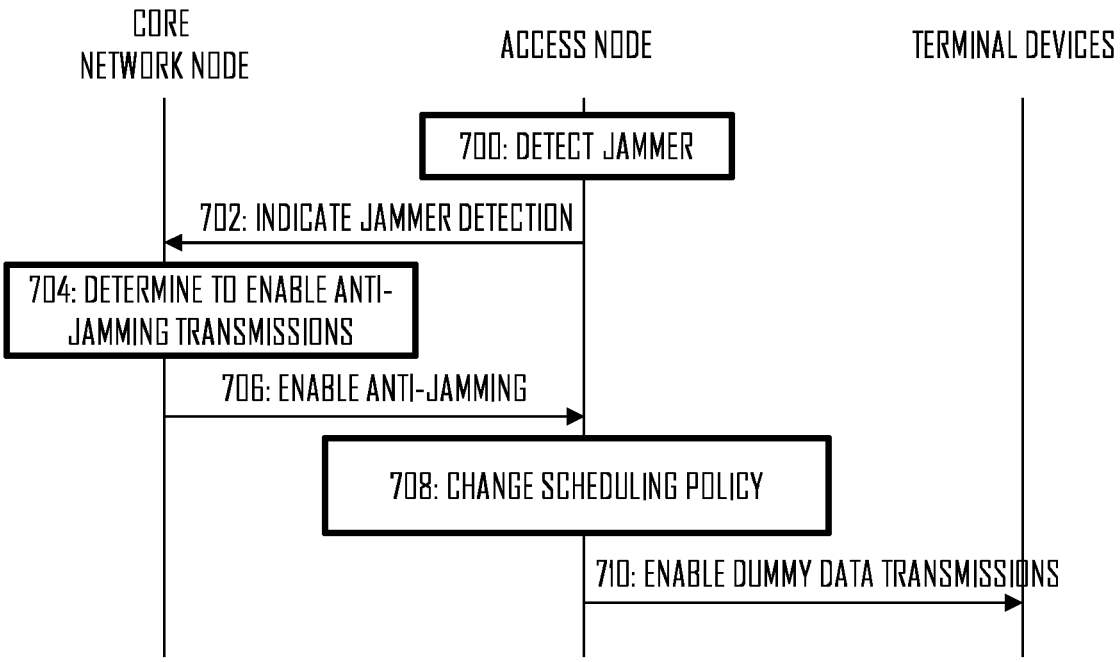
FIG. 7 illustrates a signalling diagram for enabling anti-jamming transmissions according to an embodiment.

The embodiments for breaking or hiding the regularity of the payload data transmission, denoted by anti-jamming transmissions, may be enabled and disabled by the network, e.g. by the access node or the core network node. By default, they may be disabled and enabled upon detecting presence of a jammer device. FIG. 7 illustrates a process for the enablement. Referring to FIG. 7, the access node may scan the radio channel for a presence of a jamming signal. The scanning may be carried out according to state-of-the-art principles, e.g. by blanking some time-frequency resources (physical resource blocks) for the scanning. By blanking a resource that would otherwise be a used for periodic transmission the access node may determine whether a jammer device has sniffed the periodicity and is sending a jamming signal in the resource. Another method is to measure an energy level on a selected frequency band. If the energy level exceeds a determined threshold, the jammer device may be detected. In block 700, the access node detects the jamming signal and, as a consequence, transmits a message indicating the detection to the core network node in step 702. Upon receiving the indication from the access node, the core network node may determine to enable the anti-jamming transmissions that hide the regular nature of the payload data transmissions. As a consequence, the core network node may transmit a message indicating the enablement to the access node 104 and, optionally, to other access nodes determined to be under an influence area of the jammer device. The core network node may enable the anti-jamming transmissions to only those access nodes that indicate the detection of the jammer, or it may enable the anti-jamming transmissions to neighbouring access nodes as well. In some embodiments, the access node may, in response to block 700, scan the direction and estimate location of the jammer and report the estimated location to the core network node in step 702. The core network node may then send the message in step 706 to those access nodes within a determined distance from the estimated location of the jammer.

Upon receiving the message in step 706, the access node may change the scheduling policy in the cell. For example, the access node may enable the frequency-hopping for the payload data. It may also schedule resources to the dummy data and/or it may schedule resources to the payload data such that overlapping transmissions with the dummy data is avoided or at least reduced. Since the seed and the pseudo-random generators used by the terminal devices to transmit the dummy data are also known to the core network node, the access node may also gain the information and infer the time-frequency resources where the dummy data shall be transmitted. In step 710, the access node transmits to the terminal devices one or more messages enabling the dummy data transmissions. The message may be a flag in a control message transmitted by the access node. The message may be transmitted with a reliable modulation and coding scheme to ensure reception of the message even under jamming. Another embodiment dedicates a resource element such as a sub-carrier to the message, e.g. the flag. The resource element may be reserved for the message and no other message shall be transmitted in the resource element. The terminal devices may monitor the resource element and, upon detecting radio energy above a threshold on the resource element, the dummy data transmissions may be triggered. The source for the radio energy may be the access node or the jammer so, in this embodiment, the anti-jamming transmissions may be enabled even if the jamming is very strong. In yet another embodiment, the message in step 710 is transmitted in a beacon on a dedicated frequency where no payload data transmissions are transferred. Therefore, the jammer device cannot anticipate the transmission of the message.

It should be appreciated that in some embodiments there is no need for the access node to transmit scheduling grant messages for the dummy data because the terminal devices may determine the time-frequency resources for the dummy data autonomously by using the pseudo-random generators. Accordingly, no additional scheduling signalling is needed for the dummy data transmissions.

Figure 8:
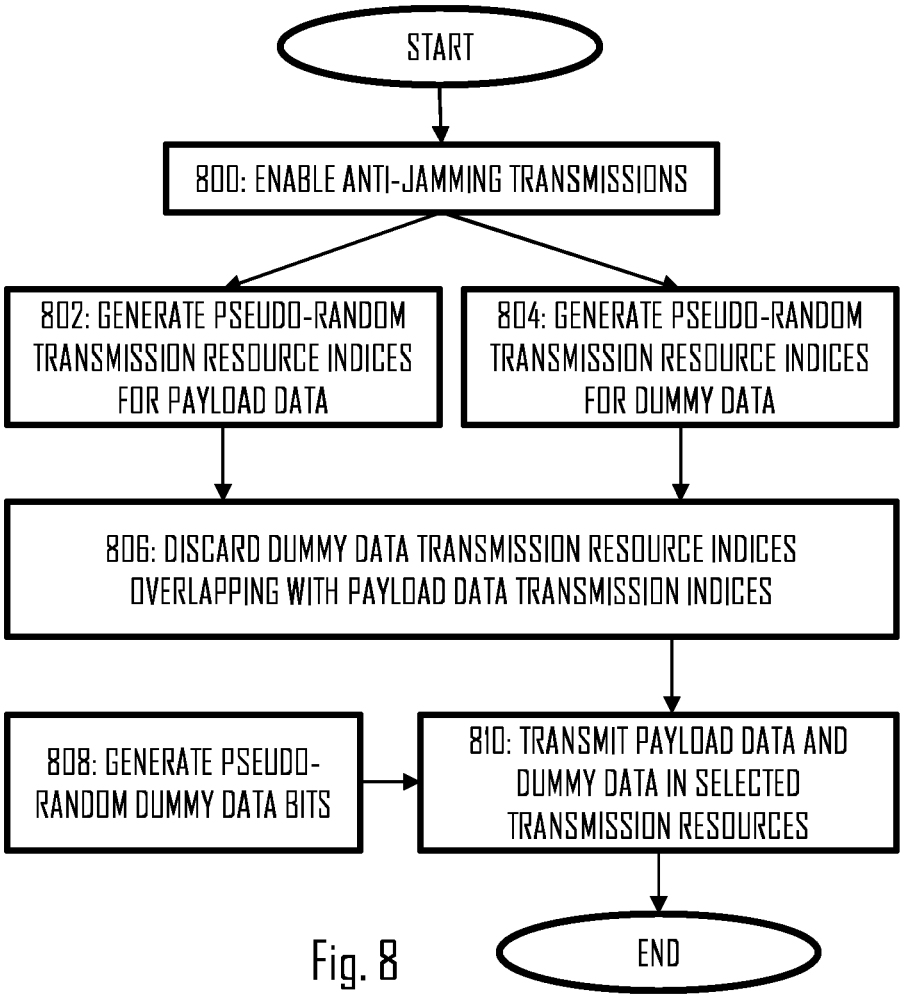
FIG. 8 illustrates an embodiment of a process for using pseudo-random generators for anti-jamming transmissions.

FIG. 8 illustrates an embodiment for the terminal device to use the pseudo-random generators to produce the pseudo-random data required for the transmission of the dummy data and, optionally, the transmission of the payload data. Referring to FIG. 8, the procedure may be triggered in block 800 by the enablement of the anti-jamming transmissions, e.g. as a result of the procedure of FIG. 7. Upon enabling the anti-jamming transmissions to break the regularity of the payload data transmissions, block 802 and/or 804 may be executed. In block 802, one or more pseudo-random generators are used to generate pseudo-random transmission resource indices for payload data. Pseudo-random data provided by the generator(s) may comprise frequency indices for the payload data to realize the frequency-hopping. The access node 104 may schedule a certain number of physical resource blocks PRBs (indexed frequency resource units) of a physical uplink shared channel (PUSCH) to the terminal device, and block 802 may be used to select a subset of the scheduled PRBs to realize the frequency-hopping.

In block 804, one or more pseudo-random generators are used to generate pseudo-random transmission resource indices for dummy data. Pseudo-random data provided by the generator(s) may comprise time-frequency indices for the dummy data to realize randomized time-frequency pattern for the dummy data. In other words, the randomization may be performed in the time domain and in the frequency domain to increase the unpredictability. Block 804 may thus output a set of pairs of time and frequency indices for the dummy data. The pseudo-random generator(s) of block 804 need not to be limited to the resources scheduled by the access node. Instead, the range for the possible frequency indices may span to the system bandwidth in the cell. The time indices may cover a determined number of future time resource units, e.g. sub-frames, symbols, time slots, or frames.

In block 806, the resource indices output from blocks 802 and 804 are compared for overlapping transmission resources. If it is found that block 804 has output a transmission resource index that overlaps with a transmission resource index output from block 802, thus indicating the both dummy data and payload data would be allocated to the same time-frequency resource, the transmission resource index (pair) of the dummy data may be discarded to remove the overlapping.

In block 808, the dummy data bits are generated by using another pseudo-random generator. In block 810, the dummy data bits are arranged to the time-frequency resources output from block 804 that pass block 806. Similarly, the payload data is arranged to the time-frequency resources scheduled to the terminal device and selected as a result of block 802. Thereafter, the payload data and the dummy data may be transmitted to the access node.

Figure 9:
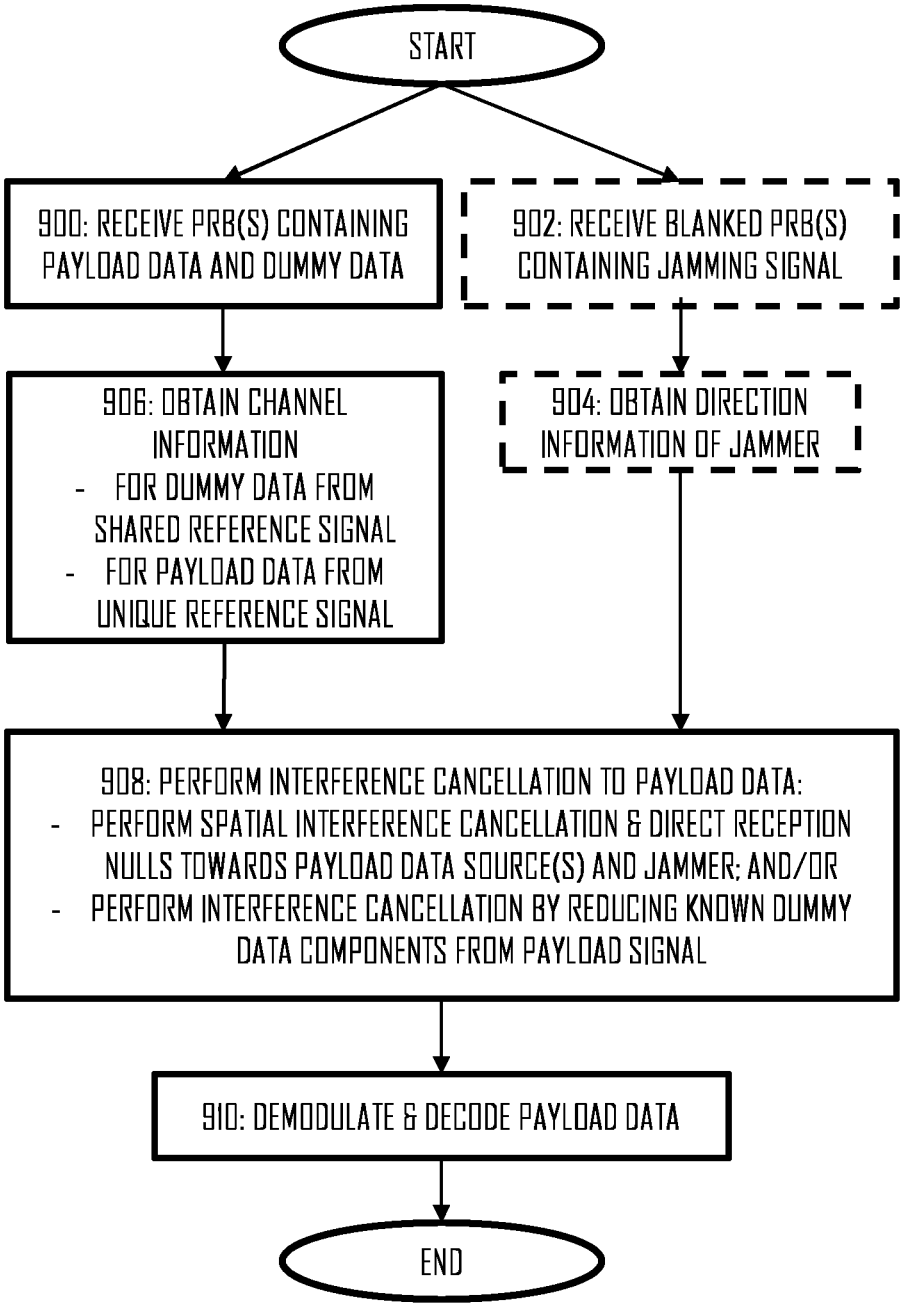
FIG. 9 illustrates an embodiment of a process for performing interference cancellation in an access node.

Let us then describe some embodiments for the interference cancellation with reference to FIG. 9. The dummy data transmitted by some terminal devices in the same time-frequency resources as the payload data transmitted by a terminal device, as in FIG. 6, may interfere with the reception of the payload data in the access node. In order to describe the interference cancellation, let us consider that the access node has M antennas simultaneously serving through spatial multiplexing a total of $K_{act}$ active terminal devices that are each transmitting payload data together with a unique reference signal over the same time-frequency resource. Another set of $K_{dec}$ terminal devices are assumed to act as decoys and transmit dummy data over the same time-frequency resource. In other words, there is a total of $K_{act}+K_{dec}$ terminal devices that utilize the same time-frequency resource. Following the embodiment of FIG. 3, at least some of the $K_{dec}$ terminal devices may share the reference signal and the dummy data, thus appearing as a single terminal device from the perspective of the access node.

Referring to FIG. 9, the access node may receive one or more PRBs containing the payload data and the dummy data in the same PRB(s) in block 900. The access node may receive (block 902) additional PRBs that have been blanked for the jammer detection and estimation of the jamming signal (block 904). By using the blanking a PRB, the access node may ensure that no terminal device is transmitting in the PRB in the cell and, thus, the signal received is substantially either noise or the jamming signal. Upon detecting the jamming signal, block 904 may be carried out and channel state towards the jammer may be estimated, including spatial directions from where the jamming signal is received.

In block 906, the access node obtains channel state information for the payload data and for the dummy data by using the respective reference signals. The channel state information for a radio channel between the terminal device transmitting the payload data may be acquired from the unique reference signal, and the channel state information for a radio channel between the virtual terminal device transmitting the dummy data may be acquired from the shared reference signal. In block 908, the access node applies interference cancellation to the payload data to remove the effect of the dummy data and the jamming signal from the payload data. Depending on a situation, block 908 may be logically split into the following cases: the number of spatial streams M the access node can distinguish is greater than $K_{act}+K_{dec}$; and the number of spatial streams M the access node can distinguish is smaller than $K_{act}+K_{dec}$. In the first case, the access node may perform spatial interference cancellation where a reception null is directed towards a reception direction or directions of the shared reference signal, i.e. towards the virtual terminal device and, in some embodiments, other decoy terminal devices. In case blocks 902 and 904 are implemented and there are available distinguishable reception nulls available to the access node, the reception null(s) may be directed towards the reception directions of the jamming signal as well. In the latter case where the access node cannot spatially separate the payload data from the dummy data and, optionally, the jamming signal, the access node may compute interference cancellation parameters on the basis of the received dummy data and the second reference signal (the known dummy data may be used as an additional reference signal), and to cancel, by using the interference cancellation parameters, a signal comprising the dummy data and the second reference signal (and optionally the jamming signal) from the signal carrying the payload data. The interference cancellation may include both the spatial interference cancellation (null steering) and the interference reduction/subtraction. There is yet another case where the access node has a single antenna in which case the interference cancellation may include only the interference signal reduction from the payload signal. In block 910, the access node may demodulate and decode the interference-cancelled payload data.

Let us then consider the interference cancellation in greater detail. A signal $Y^{(p)}$ received by the access node in time-frequency slots of the reference signal can be written as $$Y^{(p)} = \sum_{k\in\mathcal{K}_{act}} \sqrt{p_k}\, h_{act_k}\phi^T_{act_k} + \sum_{k\in\mathcal{K}_{dec}} \sqrt{f_k}\, h_{dec_k}\phi^T_{dec} + \sqrt{q}\sum_{j=1}^{N_j} h_{J_i}x^T_{J_i} + W \tag{1}$$

$$= \sum_{k\in\mathcal{K}_{act}} \sqrt{p_k}\, h_{act_k}\phi^T_{act_k} + \sqrt{f}\,\bar{h}_{dec}\phi^T_{dec} + \sqrt{q}\sum_{j=1}^{N_j} h_{J_i}x^T_{J_i} + W \tag{2}$$

where $\mathcal{K}_{act}$ is the set of all active terminal devices transmitting the payload data and $h_{act_k}\in\mathbb{C}^M$ is a channel vector of the $k^{th}$ terminal device in this set, $\phi_{act_k}\in\mathbb{C}^\tau$ is one of $\tau\geq K_{act}+1$ orthogonal reference signals transmitted by the active terminal devices, with transmit power $p_k$. Similarly, $\mathcal{K}_{dec}$ is the set of all decoy terminal devices transmitting the dummy data and $h_{dec_k}\in\mathbb{C}^M$ is the channel vector of the $k^{th}$ terminal device in this set, $\phi_{dec}\in\mathbb{C}^\tau$ is a shared reference signal transmitted by the decoy terminal devices with transmit power $f_k$. In addition, $\sqrt{f}\bar{h}_{dec}\triangleq\sum_{k\in\mathcal{K}_{dec}}\sqrt{f_k}h_{dec_k}$ in (2) is the sum of all the channel vectors of the decoy terminal devices and $W\in\mathbb{C}^{M\times\tau}$ is the additive noise. Lastly, the jammer device is assumed to be equipped with $N_J$ antennas with $h_{J_j}\in\mathbb{C}^M$ denoting the channel between the access node and the $j^{th}$ jammer antenna, and $x_{J_j}$ is the jamming signal transmitted by the $j^{th}$ jammer antenna with transmit power q. It is evident from (2), that the set of $\mathcal{K}_{dec}$ decoy terminal devices have been replaced by a single representative virtual decoy terminal device with channel vector $\bar{h}_{dec}$ since all decoy terminal devices share a common reference signal. Furthermore, the reference signals $\phi_{act_k}$ and $\phi_{dec}$ are mutually orthogonal such that $\phi_{act_k}{}^H\boldsymbol{\phi}_{act_\ell}=0$, $\forall k\neq\ell$ $\phi_{act_k}{}^H\phi_{dec}=0$, $\forall k$, and $\|\phi_{act_k}\|^2=\|\phi_{dec}\|^2=\tau$. Now, suppose that the access node has access to the spatial covariance matrices of the active terminal devices $R_{act_k}\triangleq\mathbb{E}[h_{act_k}h_{act_k}{}^H]$, the virtual decoy terminal devices $\bar{R}_{dec}\triangleq\mathbb{E}[\bar{h}_{dec}\bar{h}_{dec}{}^H]$, and the jammer channel $R_{J_j}\triangleq\mathbb{E}[h_{J_j}h_{J_j}{}^H]$, linear minimum mean square error (LMMSE) channel estimates are given as $$\hat{h}_{act_k} = R_{act_k}\left(R_{act_k} + \frac{q}{p_k\tau}\sum_{j=1}^{J} R_{J_j} + \frac{\sigma^2}{p_k\tau}I\right)^{-1}\left(\frac{1}{\tau\sqrt{p_k}}Y^{(p)}\phi^*_{act_k}\right) = R_{act_k}\left(R_{act_k} + \frac{q}{p_k\tau}\sum_{j=1}^{J} R_{J_j} + \frac{\sigma^2}{p_k\tau}I\right)^{-1}\left(h_{act_k} + \frac{\sqrt{q}}{\tau\sqrt{p_k}}\sum_{j=1}^{N_j} h_{J_j}x^T_{J_j}\phi^*_{act_k} + \frac{1}{\tau\sqrt{p_k}}W\phi^*_{act_k}\right) \tag{3}$$

-continued $$\hat{\bar{h}}_{dec} = \bar{R}_{dec}\left(\bar{R}_{dec} + \frac{q}{f\tau}\sum_{j=1}^{J} R_{J_j} + \frac{\sigma^2}{f\tau} I\right)^{-1}\left(\frac{1}{\tau\sqrt{f}} Y^{(p)}\phi^*_{dec}\right) = \bar{R}_{dec}\left(\bar{R}_{dec} + \frac{q}{f\tau}\sum_{j=1}^{J} R_{J_j} + \frac{\sigma^2}{f\tau} I\right)^{-1}\left(\bar{h}_{dec} + \frac{\sqrt{q}}{\tau\sqrt{f}}\sum_{j=1}^{N_j} h_{J_j}\left(x^T_{J_j}\phi^*_{dec}\right) + \frac{1}{\tau\sqrt{f}} W\phi^*_{dec}\right) \quad (4)$$

The access node may detect the properties of the jamming signal from blanked time-frequency resource units. For example, if $P_J$ orthogonal reference signals are not used by neither the active terminal devices nor the decoy terminal devices, are available for estimating the jammer channel, and least-square jammer channel estimates can be obtained as $$\hat{h}_{J_j} = \frac{1}{\tau} Y^{(p)}\phi^*_{jam_j} = \frac{\sqrt{q}}{\tau\sqrt{p}}\sum_{j=1}^{N_j} h_{J_j}\left(x^T_{J_j}\phi^*_{jam_j}\right) + \frac{1}{\tau\sqrt{p}} W\phi^*_{jam_j} \quad (5)$$

where the orthogonal pilots for jammer channel estimation are $\{\phi_{jam_j}\}_{j=1}^{P_J}$. The reference signal(s) $P_J$ may be transmitted any one of the decoy terminal devices, for example. The jammer channel estimates may be used in designing a jamming resistant beamforming configuration.

Next, by considering the case where all the decoy terminal devices share the same dummy data, the signal comprising the payload data and the dummy data may be represented as $$y^{(d)} = \sum_{k\in\mathcal{K}_{act}} \sqrt{p_k}\, h_{act_k} x_{act_k} + \sqrt{f}\,\bar{h}_{dec} x_{dec} + \sqrt{q}\sum_{j=1}^{N_j} h_{J_j} x_{J_j} + w \quad (6)$$

where $x_{act_k}$, $x_{dec}$, and $x_{J_j}$ are the payload data, dummy data, and jamming signals transmitted by the active terminal devices, decoy terminal devices, and $j^{th}$ jammer antenna in the time-frequency resource, respectively. Since we have an estimate of $\bar{h}_{dec}$ and since both p and $x_{dec}$ are known, it is easy to cancel the interference caused by the dummy data. Then, the observations after interference cancellation can be written as $$\tilde{y}^{(d)} \triangleq y^{(d)} - \sqrt{f}\,\hat{\bar{h}}_{dec} x_{dec} = \sum_{k\in\mathcal{K}_{act}} \sqrt{p_k}\, h_{act_k} x_{act_k} + \sqrt{f}\, e_{dec} x_{dec} + \sqrt{q}\sum_{j=1}^{N_j} h_{J_j} x_{J_j} + w \quad (7)$$

where $e_{dec}=\bar{h}_{dec}-\hat{\bar{h}}_{dec}$ is the channel estimation error corresponding to the virtual decoy terminal device. Now, the data in the $k^{th}$ payload data stream $x_{act_k}$, is recovered from $\tilde{y}^d$, given the channel estimates in (3), (4), and (5), using an LMMSE-type combiner, which is given as $$\hat{x}_{act_m} \triangleq c^H_m \tilde{y}^{(d)} \sqrt{p_k}\, \hat{h}^H_{act_m}\left(\sum_{k\in\mathcal{K}_{act}} p_k \hat{h}_{act_k}\hat{h}^H_{act_k} + fE + FF^H + \sigma^2 I\right)^{-1} \tilde{y}^{(d)} \quad (8)$$

where $$E \triangleq \mathbb{E}\left[e_{dec}e^H_{dec}\right] = \bar{R}_{dec} - \bar{R}_{dec}\left(\bar{R}_{dec} + \frac{q}{f\tau}\sum_{j=1}^{J} R_{J_i} + \frac{\sigma^2}{f\tau} I\right)^{-1}\bar{R}_{dec},$$

$F \triangleq [h_{j_1}, \ldots, \boldsymbol{h}_{J_{P_I}}]$ and the combiner $c_m$ can be written as $$c_m = \sqrt{p_k}\left(\sum_{k\in\mathcal{K}_{act}} p_k \hat{h}_{act_k}\hat{h}^H_{act_k} + fE + FF^H + \sigma^2 I\right)^{-1}\hat{h}_{act_k} \quad (9)$$

The combiner in Equation (9) simultaneously cancels the interference from the dummy data in the spatial dimension while using the knowledge of the dummy data. As described above, the dummy data is known a priori to the access node by the virtue of providing the seed to the terminal devices according to the procedure of FIG. 4.

In practice, the matrices $R_{J_j}$ may not be available at the access node since estimating them would require observing the jammer channel across several coherent time intervals, which may not be feasible. Therefore, it may be assumed that the access node uses $FF^H$ instead of $$q\sum_{j=1}^{N_J} R_{J_j},$$

and, consequently, $\hat{h}_{act_k}$ and $\hat{\bar{h}}_{dec}$ in (3), (4) are only LMMSE-type channel estimates, and (9) is an LMMSE-type combiner in the presence of a jammer.

In an embodiment, the interference is cancelled by using multi-cell coordination. Here, the payload data and dummy data may be received by both the serving access node and one or more neighboring access nodes. The serving BS access node may then utilize the additional degrees of freedom from the cooperating access node(s) as additional antennas and to cancel the interference, as described above in connection with block 906 and 908. The only difference is that, instead of using the antenna(s) of the access node itself, the antennas of the neighboring access nodes are used to receive the same time-frequency resource(s). This approach may be beneficial for edge-of-cell terminal devices.

In an embodiment, the reference signals described above are at least one of sounding reference signals and demodulation reference signals specified in the 3GPP specifications.

Figure 10:
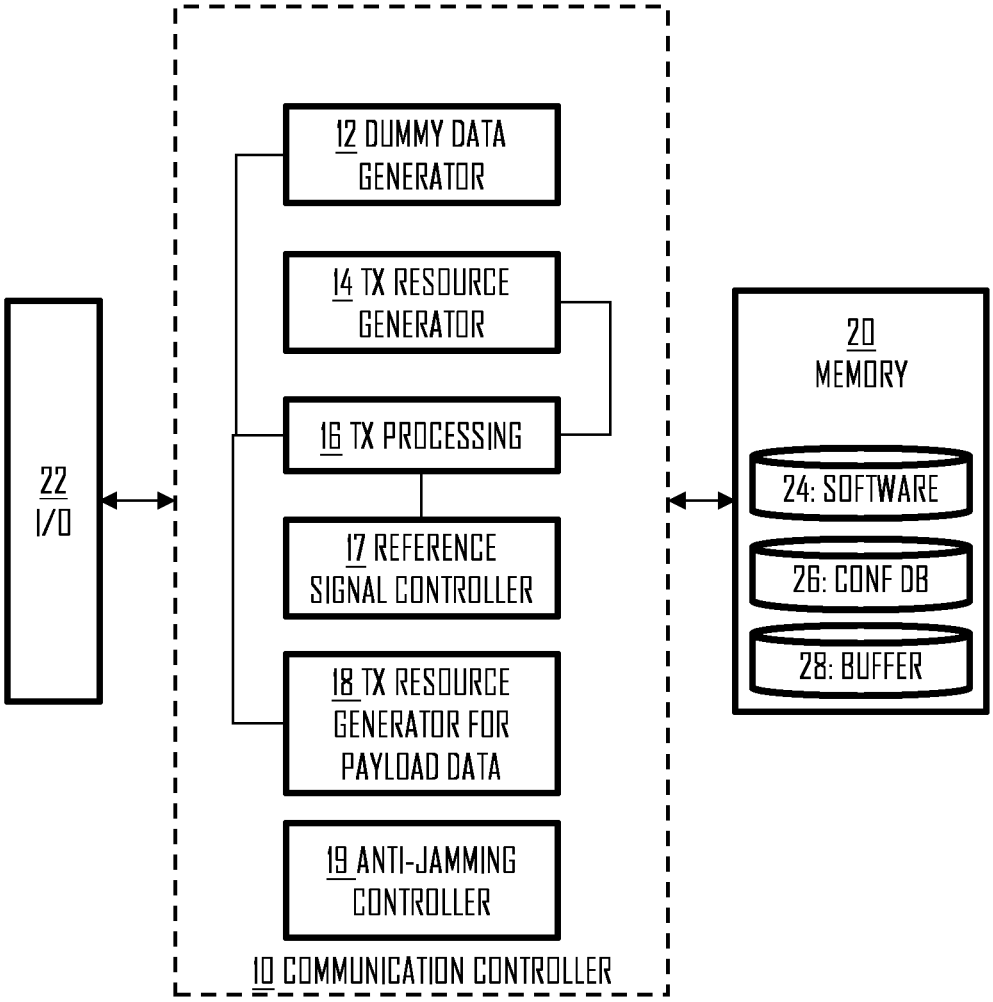
FIGS. 10 and 11 illustrate block diagrams of embodiments of apparatuses configured to carry out the respective processes of FIGS. 3 and 5.

FIG. 10 illustrates an apparatus comprising a processing circuitry, such as at least one processor, and at least one memory 20 including a computer program code (software) 24, wherein the at least one memory and the computer program code (software) are configured, with the at least one processor, to cause the apparatus to carry out the process of FIG. 3 or any one of its embodiments described above. The apparatus may be for the terminal device. The apparatus may be a circuitry or an electronic device realizing some embodiments of the invention in the terminal device. The apparatus carrying out the above-described functionalities may thus be comprised in such a device, e.g. the apparatus may comprise a circuitry such as a chip, a chipset, a processor, a micro controller, or a combination of such circuitries for the terminal device. The at least one processor or a processing circuitry may realize a communication controller 10 controlling communications with the cellular network infrastructure in the above-described manner. The communication controller may be configured to establish and manage radio connections and transfer of data over the radio connections.

The communication controller may comprise dummy data generator 12 configured to generate the dummy data according to the embodiments described above. The communication controller may further comprise a transmission resource generator 14 configured to generate the indices specifying the time-frequency resources for the dummy data, as described above. The communication controller may further comprise a reference signal controller 17 configured to manage a reference signal to be attached to the payload data and to the dummy data, as described above. The reference signal controller may be configured to attach the shared reference signal to the time-frequency resources carrying the dummy data and the unique reference signal to the time-frequency resources carrying the payload data. The reference signal controller may further manage the rotation of the reference signals, as described above.

The communication controller may further comprise a transmission resource generator 18 configured to select the time-frequency resources for the payload data, if enabled in the above-described manner. The communication controller may further comprise a transmission circuitry 16 configured to arrange the payload data and the dummy data into the respective time-frequency resources and to transmit the payload data and the dummy data to the access node over a radio interface. The communication controller may further comprise an anti-jamming controller 19 configured to enable and disable modules 12 to 16, and 18, according to the procedure of FIG. 7.

The memory 20 may be implemented using any suitable data storage technology, such as semiconductor-based memory devices, flash memory, magnetic memory devices and systems, optical memory devices and systems, fixed memory and removable memory. The memory 20 may comprise a configuration database 26 for storing configuration parameters, e.g. the seeds for the pseudo-random generators. The memory 20 may further store a data buffer 28 for uplink data to be transmitted from the apparatus.

The apparatus may further comprise a communication interface 22 comprising hardware and/or software for providing the apparatus with radio communication capability with one or more access nodes, as described above. The communication interface 22 may include, for example, an antenna, one or more radio frequency filters, a power amplifier, and one or more frequency converters. The communication interface 22 may comprise hardware and software needed for realizing the radio communications over the radio interface, e.g. according to specifications of an LTE or 5G radio interface.

Figure 11:
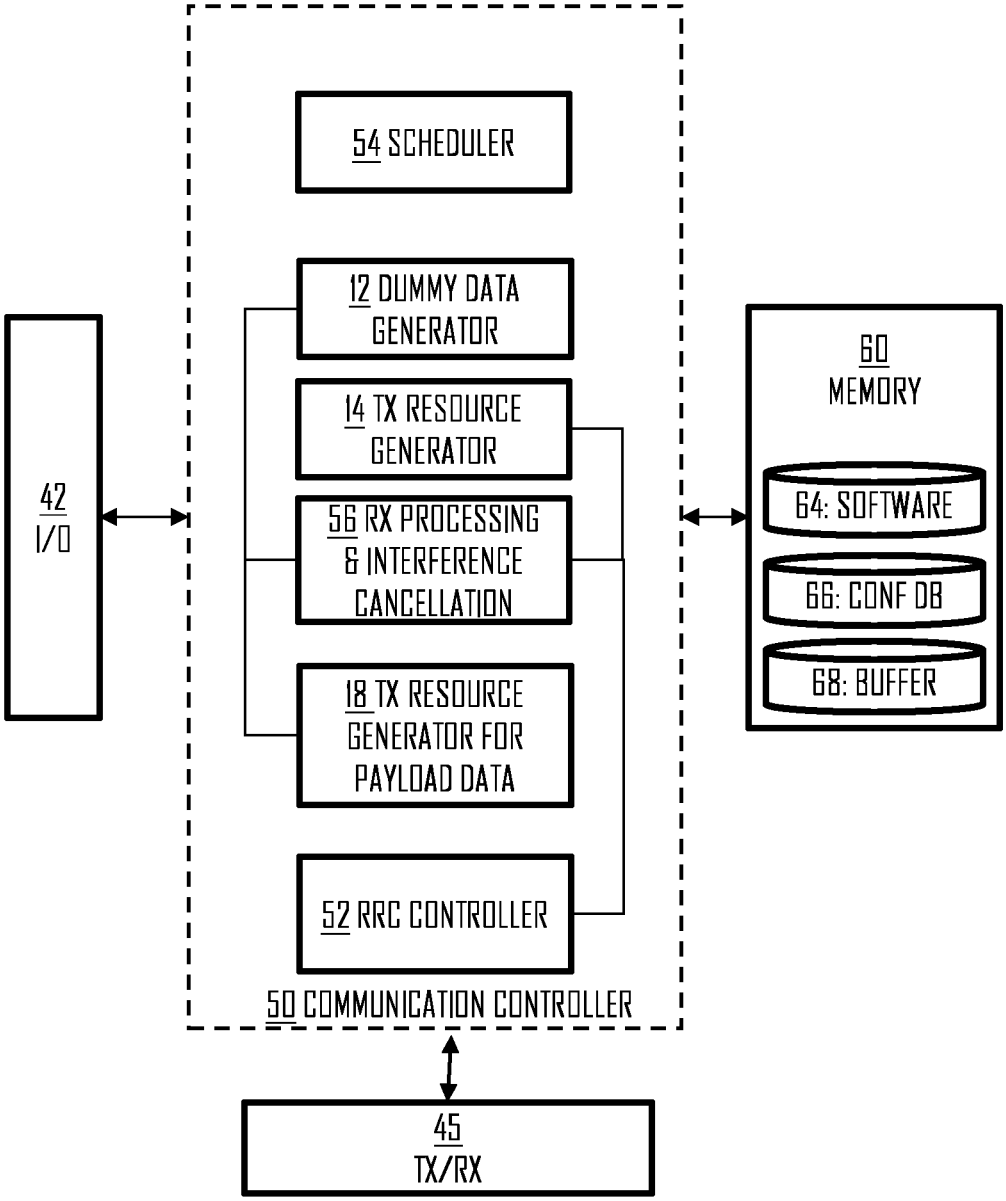

FIG. 11 illustrates an apparatus comprising a processing circuitry, such as at least one processor, and at least one memory 60 including a computer program code (software) 64, wherein the at least one memory and the computer program code (software) are configured, with the at least one processor, to cause the apparatus to carry out functions of the access node 104 in the process of FIG. 5 or any one of its embodiments described above. The apparatus may be for the access node. The apparatus may be a circuitry or an electronic device realizing some embodiments of the invention in the access node. The apparatus carrying out the above-described functionalities may thus be comprised in such a device, e.g. the apparatus may comprise a circuitry such as a chip, a chipset, a processor, a micro controller, or a combination of such circuitries for the access node. In other embodiments, the apparatus is the access node. The at least one processor or a processing circuitry may realize a communication controller 50 controlling communications with the cellular network infrastructure in the above-described manner. The communication controller may be configured to establish and manage radio connections and transfer of data over the radio connections.

The communication controller 50 may comprise an RRC controller 52 configured to establish, manage, and terminate radio connections with terminal devices served by the access node. The RRC controller 52 may be configured, for example, to establish and reconfigure the RRC connections with the terminal devices, e.g. as described above in connection with FIG. 4. The RRC controller may allocate the reference signals to the terminal devices. The communication controller may further comprise a scheduler 54 configured to schedule uplink transmission resources to the terminal devices. As described above, the scheduler may employ different scheduling policies in a normal mode and when the anti-jamming transmissions are enabled.

The communication controller 50 may comprise the same pseudo-random generators 12, 14, 18 as in the apparatus of FIG. 10, in order to generate the same dummy data and time-frequency resources as the apparatus for the terminal device. This enables the interference cancellation according to the embodiment of FIG. 9 in the receiver processing and interference cancellation circuitry 56. The RRC controller 52 may indicate the appropriate reference signals to be associated with the dummy data and the payload data, as described above.

The memory 60 may be implemented using any suitable data storage technology, such as semiconductor-based memory devices, flash memory, magnetic memory devices and systems, optical memory devices and systems, fixed memory and removable memory. The memory 60 may comprise a configuration database 66 for storing configuration parameters, e.g. the seeds for the pseudo-random generators. The configuration database may further store information on the terminal devices configured to operate as the decoy terminal devices. The memory may also comprise a data buffer 68 for downlink data.

The apparatus may further comprise a radio frequency communication interface 45 comprising hardware and/or software for providing the apparatus with radio communication capability with the terminal devices, as described above. The communication interface 45 may include, for example, an antenna array, one or more radio frequency filters, a power amplifier, and one or more frequency converters. The communication interface 45 may comprise hardware and software needed for realizing the radio communications over the radio interface, e.g. according to specifications of an LTE or 5G radio interface.

The apparatus may further comprise another communication interface 42 for communicating towards the core network. The communication interface may support respective communication protocols of the cellular communication system to enable communication with other access nodes, with other nodes of the radio access network, and with nodes in the core network and even beyond the core network. The communication interface 42 may comprise necessary hardware and software for such communications.

As used in this application, the term 'circuitry' refers to one or more of the following: (a) hardware-only circuit implementations such as implementations in only analog and/or digital circuitry; (b) combinations of circuits and software and/or firmware, such as (as applicable): (i) a combination of processor(s) or processor cores; or (ii) portions of processor(s)/software including digital signal processor(s), software, and at least one memory that work together to cause an apparatus to perform specific functions; and (c) circuits, such as a microprocessor(s) or a portion of a microprocessor(s), that require software or firmware for operation, even if the software or firmware is not physically present.

This definition of 'circuitry' applies to uses of this term in this application. As a further example, as used in this application, the term "circuitry" would also cover an implementation of merely a processor (or multiple processors) or portion of a processor, e.g. one core of a multi-core processor, and its (or their) accompanying software and/or firmware. The term "circuitry" would also cover, for example and if applicable to the particular element, a baseband integrated circuit, an application-specific integrated circuit (ASIC), and/or a field-programmable grid array (FPGA) circuit for the apparatus according to an embodiment of the invention.

The processes or methods described in FIG. 3, 5, or any of the embodiments thereof may also be carried out in the form of one or more computer processes defined by one or more computer programs. The computer program(s) may be in source code form, object code form, or in some intermediate form, and it may be stored in some sort of carrier, which may be any entity or device capable of carrying the program. Such carriers include transitory and/or non-transitory computer media, e.g. a record medium, computer memory, read-only memory, electrical carrier signal, telecommunications signal, and software distribution package. Depending on the processing power needed, the computer program may be executed in a single electronic digital processing unit or it may be distributed amongst a number of processing units.

Embodiments described herein are applicable to wireless networks defined above but also to other wireless networks. The protocols used, the specifications of the wireless networks and their network elements develop rapidly. Such development may require extra changes to the described embodiments. Therefore, all words and expressions should be interpreted broadly and they are intended to illustrate, not to restrict, the embodiment. It will be obvious to a person skilled in the art that, as technology advances, the inventive concept can be implemented in various ways. Embodiments are not limited to the examples described above but may vary within the scope of the claims.

The invention claimed is:

1. An apparatus for a terminal device, comprising:

at least one processor; and at least one memory including computer program code, wherein the at least one memory and computer program code are configured, with the at least one processor, to cause the apparatus to perform the following:

receiving a first reference signal allocation from an access node, wherein the first reference signal is unique to the terminal device in a cell managed by the access node;

receiving a second reference signal allocation from the access node, wherein the second reference signal is shared with at least one other terminal device in the cell;

causing transmission of payload data together with the first reference signal according to a regular transmission pattern; and breaking the regular transmission pattern by transmitting dummy data together with the second reference signal in a time-frequency resource shared with the at least one other terminal device.

2. The apparatus of claim 1, wherein the at least one memory and computer program code are configured, with the at least one processor, to cause the apparatus to generate the dummy data by using the same pseudo-random data generator configuration as the at least one other terminal device and to transmit the same dummy data as the at least one other terminal device in the time-frequency resource.

3. The apparatus of claim 2, wherein the at least one memory and computer program code are configured, with the at least one processor, to cause the apparatus to receive a seed for the pseudo-random data generator from the access node.

4. The apparatus of claim 1, wherein the at least one memory and computer program code are configured, with the at least one processor, to cause the apparatus to determine the time-frequency resource by using a pseudo-random generator.

5. The apparatus of claim 4, wherein the at least one memory and computer program code are configured, with the at least one processor, to cause the apparatus to:

generate the dummy data by using the same pseudo-random data generator configuration as the at least one other terminal device and to transmit the same dummy data as the at least one other terminal device in the time-frequency resource; and use a time-frequency resource index indicating the determined time-frequency resource as a seed for the pseudo-random data generator configured to generate the dummy data for the determined time-frequency resource.

6. The apparatus of claim 1, wherein the at least one memory and computer program code are configured, with the at least one processor, to cause the apparatus to transmit first payload data together with the first reference signal, to change to a third reference signal that is also unique to the terminal device in the cell, and to transmit second payload data together with the third reference signal.

7. The apparatus of claim 1, wherein the at least one memory and computer program code are configured, with the at least one processor, to cause the apparatus to enable the transmission of the dummy data upon receiving, from the access node, a message configuring the dummy data transmission.

8. An apparatus for a network node, comprising:

at least one processor; and at least one memory including computer program code, wherein the at least one memory and computer program code are configured, with the at least one processor, to cause the apparatus to perform the following:

transmitting, to a first terminal device, an allocation of a first reference signal that is unique to the first terminal device in a cell managed by the access node and, further, an allocation of a second reference signal;

transmitting, to a second terminal device, an allocation of the second reference signal; and receiving, from the first terminal device, payload data together with the first reference signal according to a regular transmission pattern and, further, receiving from the first terminal device and the second terminal device dummy data together with the second reference signal in a time-frequency resource shared between the first terminal device and the second terminal device.

9. The apparatus of claim 8, wherein the at least one memory and computer program code are configured, with the at least one processor, to cause the apparatus to perform, on the basis of the received second reference signal, a spatial interference cancellation where a reception null is directed towards a reception direction or directions of the second reference signal.

10. The apparatus of claim 8, wherein dummy data received from the first terminal device is identical with the dummy data received from the second terminal device, and wherein the at least one memory and computer program code are configured, with the at least one processor, to cause the apparatus to compute interference cancellation parameters on the basis of the received dummy data and the second reference signal, and to cancel, by using the interference cancellation parameters, a signal comprising the dummy data and the second reference signal from a signal carrying payload data received from a third terminal device in the time-frequency resource.

11. The apparatus of claim 8, wherein the at least one memory and computer program code are configured, with the at least one processor, to cause the apparatus to transmit to the first terminal device and the second terminal device a seed for a pseudo-random data generator generating the dummy data, wherein the seed is the same for the first terminal device and the second terminal device.

12. The apparatus of claim 8, wherein the at least one memory and computer program code are configured, with the at least one processor, to cause the apparatus to transmit to the first terminal device and the second terminal device a seed for a pseudo-random generator determining the time-frequency resource, wherein the seed is the same for the first terminal device and the second terminal device.

13. The apparatus of claim 8, wherein the at least one memory and computer program code are configured, with the at least one processor, to cause the apparatus to transmit to the first terminal device and the second terminal device a seed for a pseudo-random generator determining the time-frequency resource, wherein the seed is different for the first terminal device than for the second terminal device, to receive from the first terminal device and second terminal device different dummy data when the first terminal device transmits the dummy data in a different time-frequency resource than the second terminal device, and to receive from the first terminal device and second terminal device same dummy data when the first terminal device and the second terminal device both transmit the dummy data in the same time-frequency resource.

14. The apparatus of claim 8, wherein the at least one memory and computer program code are configured, with the at least one processor, to cause the apparatus to transmit to the first terminal device a configuration defining how to change the first reference signal to a third reference signal that is also unique to the first terminal device in the cell, and to receive further payload data together with the third reference signal from the first terminal device.

15. The apparatus of claim 8, wherein the at least one memory and computer program code are configured, with the at least one processor, to cause the apparatus to detect presence of a radio jamming device and, in response to said detection, transmit to the first terminal device and the second terminal device a message enabling the transmission of the dummy data.

16. A method comprising:

receiving, by a terminal device, a first reference signal allocation from an access node, wherein the first reference signal is unique to the terminal device in a cell managed by the access node;

receiving, by the terminal device, a second reference signal allocation from the access node, wherein the second reference signal is shared with at least one other terminal device in the cell;

causing, by the terminal device, transmission of payload data together with the first reference signal according to a regular transmission pattern; and breaking, by the terminal device, the regular transmission pattern by transmitting dummy data together with the second reference signal in a time-frequency resource shared with the at least one other terminal device.

17. A method comprising:

transmitting, by an access node to a first terminal device, an allocation of a first reference signal that is unique to the first terminal device in a cell managed by the access node and, further, an allocation of a second reference signal;

transmitting, by the access node to a second terminal device, an allocation of the second reference signal; and receiving, by the access node from the first terminal device, payload data together with the first reference signal according to a regular transmission pattern and, further, receiving from the first terminal device and the second terminal device dummy data together with the second reference signal in a time-frequency resource shared between the first terminal device and the second terminal device.

18. A computer program embodied on a non-transitory computer-readable medium and comprising a computer program code readable by a computer, wherein the computer program code configures the computer to carry out a computer process for a terminal device, comprising:

receiving a first reference signal allocation from an access node, wherein the first reference signal is unique to the terminal device in a cell managed by the access node;

receiving a second reference signal allocation from the access node, wherein the second reference signal is shared with at least one other terminal device in the cell;

causing transmission of payload data together with the first reference signal according to a regular transmission pattern; and breaking the regular transmission pattern by transmitting dummy data together with the second reference signal in a time-frequency resource shared with the at least one other terminal device.

19. A computer program embodied on a non-transitory computer-readable medium and comprising a computer program code readable by a computer, wherein the computer program code configures the computer to carry out a computer process for an access node, comprising:

transmitting, to a first terminal device, an allocation of a first reference signal that is unique to the first terminal device in a cell managed by the access node and, further, an allocation of a second reference signal;

transmitting, to a second terminal device, an allocation of the second reference signal; and receiving, from the first terminal device, payload data together with the first reference signal according to a regular transmission pattern and, further, receiving from the first terminal device and the second terminal device dummy data together with the second reference signal in a time-frequency resource shared between the first terminal device and the second terminal device.

* * * * *